US007063780B2

(12) United States Patent
Mogi et al.

(10) Patent No.: US 7,063,780 B2
(45) Date of Patent: Jun. 20, 2006

(54) METHOD FOR INDIRECT-ELECTRIFICATION-TYPE CONTINUOUS ELECTROLYTIC ETCHING OF METAL STRIP AND APPARATUS FOR INDIRECT-ELECTRIFICATION-TYPE CONTINUOUS ELECTROLYTIC ETCHING

(75) Inventors: Hisashi Mogi, Futtsu (JP); Naruhiko Nomura, Futtsu (JP); Shigenobu Koga, Futtsu (JP); Masahiro Fujikura, Futtsu (JP); Shuichi Yamazaki, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 209 days.

(21) Appl. No.: 10/378,534

(22) Filed: Mar. 3, 2003

(65) Prior Publication Data

US 2003/0164307 A1 Sep. 4, 2003

(30) Foreign Application Priority Data

Mar. 4, 2002 (JP) ..... 2002-056749
Aug. 15, 2002 (JP) ..... 2002-236913

(51) Int. Cl.
*C25F 3/06* (2006.01)

(52) U.S. Cl. ..... 205/659; 205/666

(58) Field of Classification Search ..... 205/646, 205/658–659

See application file for complete search history.

(56) References Cited

U.S. PATENT DOCUMENTS

| | | | | |
|---|---|---|---|---|
| 5,013,374 | A * | 5/1991 | Block et al. | 148/113 |
| 5,417,818 | A * | 5/1995 | Linhard | 205/685 |
| 2002/0000265 | A1* | 1/2002 | Toda et al. | 148/307 |

FOREIGN PATENT DOCUMENTS

| | | | |
|---|---|---|---|
| CA | 2384244 | | 4/2001 |
| DE | 19951325 | | 5/2001 |
| JP | 60-211012 | A | 10/1985 |
| JP | 62-86182 | A | 4/1987 |
| JP | 63-42332 | A | 2/1988 |
| JP | 1-279711 | A | 11/1989 |
| JP | 04-088121 | A | 3/1992 |
| JP | 10130898 | | 5/1998 |
| JP | 10-204699 | A | 8/1998 |

OTHER PUBLICATIONS

European Search Report with abstract, EP 03 00 4385, dated Oct. 27, 2003.

* cited by examiner

*Primary Examiner*—Roy King
*Assistant Examiner*—Michael P. Alexander
(74) *Attorney, Agent, or Firm*—Baker Botts LLP

(57) ABSTRACT

The present invention provides a method for indirect-electrification-type continuous electrolytic etching of a metal strip suitable for producing a low-core-loss, grain-oriented silicon steel sheet not susceptible to the deterioration of core loss after stress-relief annealing, and an apparatus for the indirect-electrification-type continuous electrolytic etching. It is a method for indirect-electrification-type continuous electrolytic etching of a metal strip and an apparatus for the same for continuously forming grooves by indirect-electrification-type electrolytic etching on a metal strip on which an etching mask is formed in etching patterns on one or both surfaces, wherein: plural electrodes of an A series and a B series are arranged alternatively, at least in a pair, in said order in the travelling direction of the metal strip so that they face the surface to be etched of the metal strip on which the etching patterns are formed; the space between the metal strip and the group of the electrodes is filled with an electrolyte; and voltage is applied across the A series and B series electrodes.

11 Claims, 6 Drawing Sheets

METHOD FOR INDIRECT-ELECTRIFICATION-TYPE CONTINUOUS ELECTROLYTIC ETCHING OF METAL STRIP AND APPARATUS FOR INDIRECT-ELECTRIFICATION-TYPE CONTINUOUS ELECTROLYTIC ETCHING

CROSS-REFERENCE TO RELATED APPLICATIONS

This application claims priority under 35 U.S.C. 119 from Japanese Patent Application No. 2002-056749 filed on Mar. 4, 2002, and from Japanese Patent Application No. 2002-236913 filed on Aug. 15, 2002. The entire disclosures of these applications are incorporated herein by reference.

1. Technical Field

The present invention relates to a method for indirect-electrification-type continuous electrolytic etching of a metal strip and an apparatus for the indirect-electrification-type continuous electrolytic etching, and, in particular, to a method for indirect-electrification-type continuous electrolytic etching of a metal strip suitable for producing a low-core-loss, grain-oriented silicon steel sheet, not susceptible to the deterioration of core loss after stress-relief annealing, used for the magnet core of a power supply transformer and the like, and an apparatus for the indirect-electrification-type continuous electrolytic etching.

2. Background Art

A grain-oriented electrical steel sheet presently used for a practical application is easily magnetized in the direction of its rolling, and it is used mainly for electric machinery such as transformers. When magnetic domain refinement is applied to the steel sheet by introducing local strain or forming grooves, the eddy current flowing in a section of the steel sheet is diminished and the generation of thermal energy is inhibited and, as a result, core loss is reduced. The energy loss of electric machinery can thus be decreased.

However, if a common method using laser beam irradiation is employed for the magnetic domain refinement, its effect is lost during the stress-relief annealing, at about 800° C., applied after the steel sheet is assembled into the form of a wound transformer core at a user's plant. As techniques for giving the magnetic domains refinement that is not lost during the stress-relief annealing, those for physically forming grooves are effective. For example, Japanese Unexamined Patent Publication No. S60-211012 discloses a method for controlling secondary recrystallization by forming grooves on a cold-rolled steel sheet using a roll having protrusions, Japanese Unexamined Patent Publication No. S62-86182 discloses a method for forming linear grooves periodically by spraying a solution of nitric acid to a final-annealed steel sheet, and Japanese Unexamined Patent Publication No. S63-42332 discloses a method for forming grooves by electrolytic etching prior to final annealing.

Various methods have been disclosed, as cited above, in relation to the production of a low-core-loss, grain-oriented electrical steel sheet the core loss of which is not deteriorated by stress-relief annealing, and, as for the techniques employing the formation of grooves by etching, a number of production methods have been proposed. For instance, using the method of forming grooves by spraying nitric or some other acid after final annealing, it is possible to selectively use good portions of a steel material which have recrystallized after annealing, and, thus, the grooves can be formed after sorting out unsuitable portions as required, but a sophisticated technology is required for homogeneously controlling the depth of the grooves.

With regard to the method of forming grooves by electrolytic etching prior to final annealing, on the other hand, while it is superior to the spraying method in the control of groove depth, if there are portions where the recrystallization during the final annealing is poor and said effect is not obtained after the groove formation but, rather, an adverse effect to deteriorate the property results.

None of these production methods satisfies both the selectivity to allow the groove formation only at the portions of good recrystallization and the controllability of the groove depth, and none can be viewed as really excellent industrially. Besides, iron dissolves in an electrolyte from the grooves, and it is necessary to consider a method for effectively disposing of the electrolyte and dissolved iron.

In the meantime, examples of conventional technologies for improving material characteristics of a metal strip by forming an electrically insulating etching mask (etching resist) in a selective manner (in etching patterns) on a metal strip such as a steel sheet and continuously forming grooves on it by electrolytic etching include the inventions of production methods of a low-core-loss, grain-oriented electrical steel sheet suitable for use as the magnetic core of a transformer or other electric machinery, the inventions being disclosed in the Japanese Unexamined Patent Publication No. S63-42332 mentioned above, Japanese Examined Patent Publication H8-6140 and so on.

The direct electrification and indirect electrification methods have been studied in relation to continuous electrolytic etching. However, it is difficult, by the indirect electrification method, to precisely control the amount of etching owing to a short circuit current, as seen in the problem recognized in the invention of an apparatus for direct-electrification-type electrolytic etching disclosed in Japanese unexamined Patent Publication No. H10-204699, for example, and, for this reason, the indirect electrification method has not been industrially applied to continuous electrolytic etching so far.

An outline of a conventional apparatus for the direct-electrification-type continuous electrolytic etching of a metal strip is explained below based on an example of the invention disclosed in the Japanese Unexamined Patent Publication No. H10-204699. The apparatus is, as shown in FIG. 7, an electrolytic etching apparatus for a metal strip with an electrically insulating etching resist applied to one of the surfaces, and has an electrolytic etching tank 2, conductor rolls 16 functioning as anodes, back-up rolls 17 arranged in contact with the conductor rolls 16 with a metal strip 1 in between, a cathode 15 immersed in an electrolyte 3 in the electrolytic etching tank 2, and immersion rolls 13 for immersing the metal strip 1 in the electrolyte 3. The metal strip 1 goes through the tank with its surface covered with the etching resist facing downward, and the cathode 15 is arranged so as to face toward the surface of the metal strip 1 covered with the etching resist and in a manner to keep a prescribed distance from the surface of the metal strip 1 covered with the etching resist. The conductor rolls 16 are arranged so as to touch the surface of the metal strip 1 not covered with the etching resist and the back-up rolls 17 so as to touch the surface of the metal strip 1 covered with the etching resist, respectively. The anodes and cathode are connected to a direct current power supply unit 7 and electrolytic etching is performed by directly electrifying the metal strip 1. In addition, the conductor rolls 16 are provided outside the electrolyte 3 in the electrolytic etching tank 2, and, thus, a short circuit current is prevented from occurring.

By the way, in the technical field of electrolytic pickling, which is a different technical field from the electrolytic etching but similar to it, the method of continuously processing a metal strip by the indirect electrification has been industrially applied in commercial practice. As one of such technologies, an invention of an electrolytic pickling apparatus for steel material having an effect to favorably reduce leakage current by arranging, as shown in FIG. 8, an electrically nonconductive material 6 between an anode 18 and a cathode 15 in an electrolytic tank 2 is disclosed in Japanese Unexamined Patent Publication No. H6-220699.

In a conventional method of the direct-electrification-type continuous electrolytic etching mentioned earlier, because a metal strip is directly electrified through a conductor roll, as a matter of course, the surface of the metal strip contacting the conductor roll has to be maintained electrically conductive (to have electric conductivity). By such a conventional technology, the surface of a metal strip that can be electrolytically etched in one process using an electrically insulating etching resist formed into etching patterns is inevitably limited to the side of the metal strip not contacting the conductor roll, and, for this reason, when it is necessary to apply the electrolytic etching to both the surfaces of a metal strip, it is necessary to subject the metal strip to a total of two steps of the treatment process, one for each side, which fact leads not only to the problem of an elevated production cost but also to another of poor productivity.

Besides, even in the case of electrolytic etching of only one surface of a metal strip, when both the surfaces of a metal strip are covered beforehand with electrically insulating coating films through some pretreatment and the films cannot be removed for reasons related to the nature of the product or their removal constitutes an economically heavy burden, there arises the problem of the conventional technology itself being inapplicable to the electrolytic etching.

The problems mentioned above are possibly solved by changing the method of the electrolytic etching from the direct electrification method to the indirect electrification method, but, as the electrolytic etching by the indirect electrification method is a technology not industrially applied in the past, there are various unclear issues in relation to the conditions of electrolytic etching, the stability of the product quality after the electrolytic etching (the shape of the grooves, and the like) and so forth, and, thus, it cannot be viewed as technically mature.

Given the above situation, for favorably solving said problems of conventional technologies, the present invention employs the continuous electrolytic etching technology by the indirect electrification, which has hitherto not been applied to industrial practice, and favorably solves the conventional problems of the indirect-electrification-type continuous electrolytic etching technology. As a consequence to the above, the present invention stabilizes the shape of the grooves to be formed through the etching and makes the width and depth of the grooves more even, realizes both the selectivity of processing subjects to enable the formation of grooves only on selected coils or steel sheets having good recrystallization and the controllability of the groove depth, and improves also the efficiency of the treatment of electrolyte. Thus, the object of the present invention is to provide a method for indirect-electrification-type continuous electrolytic etching of a metal strip suitable, in particular, for producing a low-core-loss, grain-oriented silicon steel sheet, not susceptible to the deterioration of core loss after stress-relief annealing, used for the magnet core of a power supply transformer and the like, and an apparatus for the indirect-electrification-type continuous electrolytic etching.

SUMMARY OF THE INVENTION

The gist of the present invention, which has been established for solving the above problems, is as follows:

(1) A method for indirect-electrification-type continuous electrolytic etching of a metal strip for continuously forming grooves by indirect-electrification-type electrolytic etching on a metal strip to be etched on one or both surfaces and having an etching mask formed in etching patterns at least on the surface to be etched, characterized by continuously and electrolytically etching a steel sheet by: arranging plural electrodes of an A series and a B series alternately, at least in a pair, in said order in the travelling direction of the metal strip so that they face the surface of the metal strip to be etched; filling the space between the metal strip and the group of electrodes with an electrolyte; and applying voltage across the A series and B series electrodes.

(2) A method for indirect-electrification-type continuous electrolytic etching of a metal strip according to the item (1), characterized by, in applying voltage across the A series and B series electrodes, alternately repeating (I) a voltage application wherein an A series electrode becomes a cathode for a period of time M of 3 to 10 msec. and (II) a voltage application wherein the A series electrode becomes an anode for a period of time N of 4×M to 20×M msec.

(3) A method for indirect-electrification-type continuous electrolytic etching of a metal strip according to the item (2), characterized by discontinuing the voltage application across the A series and B series electrodes for a period of time $\alpha$ msec. ($\alpha>0$) at the change from the voltage application of the item (I) to the voltage application of the item (II) and/or for a period of time $\beta$ msec. ($\beta>0$) at the change from the voltage application of the item (II) to the voltage application of the item (I).

(4) A method for indirect-electrification-type continuous electrolytic etching of a metal strip according to any one of the items (1) to (3), characterized in that the final electrode within the electrodes arranged in the travelling direction of the metal strip is a B series electrode.

(5) A method for indirect-electrification-type continuous electrolytic etching of a metal strip according to any one of the items (1) to (3), characterized by using, as the plural electrodes, a group of electrodes consisting of a pair of two electrodes, an A series electrode and a B series electrode lined up in said order in the travelling direction of the metal strip, as a minimum unit, per side of the metal strip.

(6) A method for indirect-electrification-type continuous electrolytic etching of a metal strip according to any one of the items (1) to (3), characterized: in that the metal strip is a final-annealed grain-oriented silicon steel sheet having an insulating coating film on a surface; and by using the insulating coating film as the etching mask.

(7) A method for indirect-electrification-type continuous electrolytic etching of a metal strip according to any one of the items (1) to (3), characterized in that the metal strip is a cold-rolled grain-oriented silicon steel sheet.

(8) A method for indirect-electrification-type continuous electrolytic etching of a metal strip according to the item (6), characterized in that the insulating coating film of the grain-oriented silicon steel sheet has a forsterite coating film on the surface and a surface-tension insulating coating film formed on said coating film.

(9) A method for indirect-electrification-type continuous electrolytic etching of a metal strip according to the item (6), characterized in that the insulating coating film of the grain-oriented silicon steel sheet has a surface-tension insulating coating film formed on the surface of the steel base material.

(10) A method for indirect-electrification-type continuous electrolytic etching of a metal strip according to any one of the items (1) to (3), characterized by controlling the value of pH of the electrolyte to 2 or higher and 11 or lower.

(11) A method for indirect-electrification-type continuous electrolytic etching of a metal strip according to any one of the items (1) to (3), characterized by controlling the value of pH of the electrolyte to 2 or higher and 7 or lower.

(12) A method for indirect-electrification-type continuous electrolytic etching of a metal strip according to any one of the items (1) to (3), characterized by controlling the value of pH of the electrolyte to 8 or higher and 11 or lower.

(13) An apparatus for indirect-electrification-type continuous electrolytic etching of a metal strip for continuously forming grooves by indirect-electrification-type electrolytic etching on a metal strip to be etched at one or both surfaces and having an etching mask formed in etching patterns at least on the surface to be etched, characterized by having:

(a) an electrolytic etching tank;

(b) a group of electrodes consisting of plural electrodes arranged at least in a pair of an A series electrode and a B series electrode lined up alternately in said order in the travelling direction of the metal strip at least on the side facing the surface to be etched of the metal strip, and being immersed in the electrolyte in the electrolytic etching tank;

(c) an insulating plate composed of an electrically non-conductive material, arranged between an A series electrode and a B series electrode adjacent to each other so as to face the same surface of the metal strip; and (d) an electric power supply unit for performing the voltage control across an A series electrode and a B series electrode arbitrarily combining (I) a type of voltage control wherein an A series electrode becomes a cathode for a prescribed period of time M, (II) a type of voltage control wherein the A series electrode becomes an anode for a prescribed period of time N (N>M), and (III) a type of voltage control wherein a voltage is not applied to the A series electrode for a prescribed period of time.

(14) An apparatus for indirect-electrification-type continuous electrolytic etching of a metal strip according to the item (13), characterized in that the final electrode within the electrodes arranged in the travelling direction of the metal strip is a B series electrode.

(15) An apparatus for indirect-electrification-type continuous electrolytic etching of a metal strip according to the item (13), characterized by arranging, as the plural electrodes, a group of electrodes consisting of a pair of two electrodes, an A series electrode and a B series electrode lined up in said order in the travelling direction of the metal strip, as a minimum unit, per side of the metal strip.

BRIEF DESCRIPTION OF THE DRAWINGS

FIG. 2 is a diagram showing an example of the voltage application across electrodes a and b in the apparatus for carrying out the method according to the present invention in terms of the voltage of the electrode a.

THE MOST PREFERRED EMBODIMENT

The present invention is explained hereafter.

For the purpose of studying the indirect-electrification-type continuous electrolytic etching of a metal strip, the present inventors continuously formed grooves by "electrolytic etching" on metal strips with an etching mask formed selectively (in etching patterns) on one surface and another etching mask covering all the other surface as in the "electrolytic pickling" described in said Japanese Unexamined Patent Publication No. H6-220699.

Figure 1:
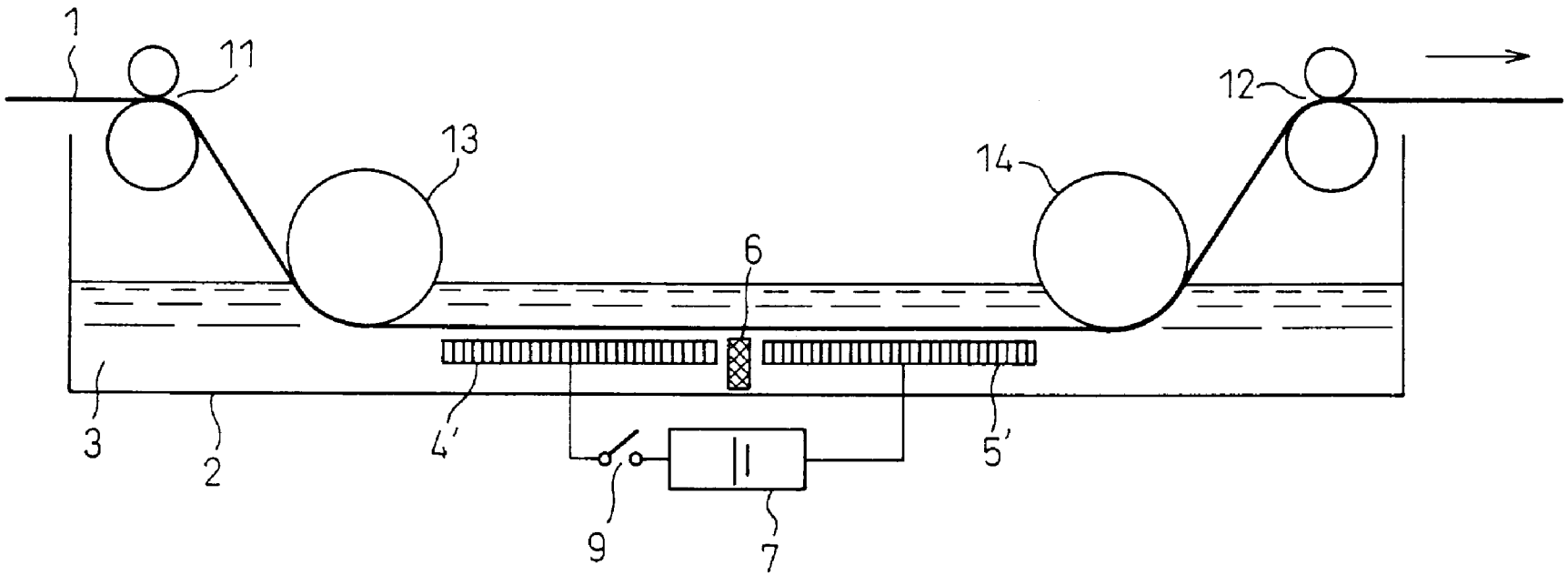
FIG. 1 is a schematic illustration, in the form of a longitudinal elevation view in section, of an apparatus for carrying out the method according to the present invention for continuously forming grooves by indirect-electrification-type electrolytic etching on a metal strip on which an etching mask is formed in etching patterns at least on one of the surfaces.

FIG. 1 schematically shows, in the form of a longitudinal elevation view in section, an apparatus for carrying out the method according to the present invention. Its main configuration is as follows. Facing the surface to be etched of a metal strip 1 continuously fed having an etching mask formed selectively (in etching patterns) on one of the surfaces, an electrode a 4' and an electrode b 5' are arranged in this order in the travelling direction of the metal strip. The space between the metal strip 1 and the electrodes a 4' and b 5' is filled with an electrolyte 3. A direct current electric power supply apparatus 7 is connected to the electrodes a 4' and b 5'. A switch 9 is provided between the direct current electric power supply apparatus 7 and the electrode a 4', and, by closing the switch 9, a voltage is applied across the electrodes a 4' and b 5' in a manner that the electrode a 4' becomes an anode. By opening the switch 9, the voltage application is discontinued. As conveyer rolls for the metal strip 1, wringer rolls 11 and 12 are provided at the entry and exit of an electrolysis tank 2 for preventing the electrolyte 3 from flowing out of the tank. Sink rolls 13 and 14 are provided in the tank for maintaining the distance from the electrodes a 4' and b 5' to the metal strip 1 constant.

Figure 2:
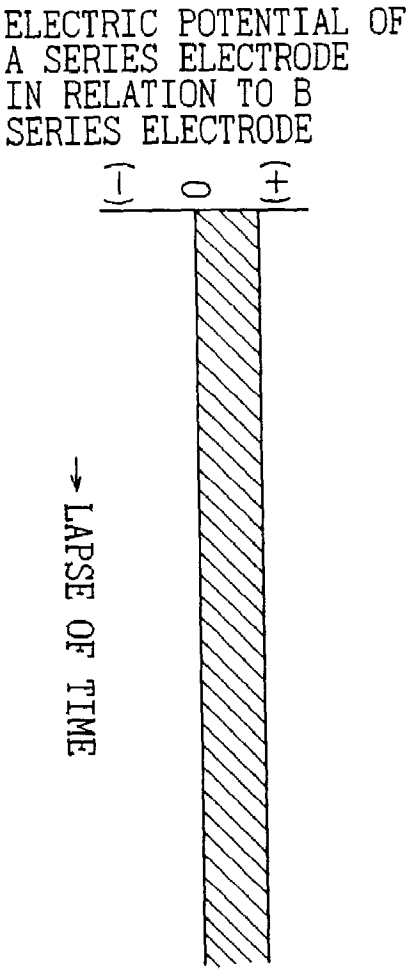

An example of the voltage application across the electrodes a 4' and b 5' of the apparatus shown in FIG. 1 is shown in FIG. 2 in terms of the voltage of the electrode a 4'. Under the voltage application, electrolytic current flows from the electrode a 4' to the metal strip 1 through the electrolyte 3 and the etching pattern portion of the metal strip 1 facing said electrode, and then to the electrode b 5' through the etching pattern portion of the metal strip 1 and the electrolyte 3 facing the electrode b 5'.

Note that, for the purpose of inhibiting the direct flow of the electric current from the electrode a 4' to the electrode b 5' through the electrolyte 3, an insulating plate 6 made of an electrically nonconductive material is provided between the electrodes a 4' and b 5' in the electrolysis tank 2. Further, since the electrode a 4' is an anode, in order that the electrode itself is not etched, an insoluble electrode of a Pt material is used for it. On the other hand, the electrode b 5' is a cathode and an electrode made of JIS SUS316 is used for it.

Using the apparatus of FIG. 1 as described above, the present inventors applied voltage across the electrodes a and b in a manner shown in FIG. 2 in terms of the voltage of the electrode a, formed grooves by electrolytic etching on metal strips 1 having an etching mask formed selectively (in etching patterns), and observed the shape (geometrical shape, width and depth) of the grooves thus formed.

Note that the metal strips 1 used here were final-annealed grain-oriented silicon steel sheets, and coating films of forsterite ($Mg_2SiO_4$) forming during the final annealing and tension coating films (insulating coating films of a phosphate) on top of said coating films had been formed on both their surfaces through painting and then baking. On one of the surfaces, etching patterns had been formed in which the forsterite coating film and the tension coating film were selectively removed by a laser beam to expose the steel base material. Note that, as the tension coating film is an electrically insulating coating film, it can be used as an etching mask. An aqueous solution of NaCl was used as the electrolyte 3.

As a result, grooves ten to several tens of micrometers in depth were formed on the surface of the steel sheets. That is, cathodic and anodic electrodes were arranged alternately in the travelling direction of the steel sheet, the electric current was supplied to the steel sheet through the portions (etching patterns) of the etching mask formed on the surface of the steel sheets where the steel base material was exposed, and the exposed portions were efficiently etched to form the grooves. Electrolytic etching is viable by this method, as the electric current flows through the etching pattern portions even in the case of a grain-oriented silicon steel sheet with insulating coating films formed on the surfaces such as a final-annealed steel sheet. It follows therefore that, even when there are portions of poor recrystallization after final annealing, the unsuitable positions can be clearly identified upon uncoiling a coil, and it is possible to select the coils or steel sheets with which good effects are obtained through the electrolytic etching and apply the treatment only to them, and the efficiency of the electrolytic etching treatment can thus be enhanced.

It goes without saying that, in the case of a steel sheet not having the insulating coating films, the electrolytic etching is applicable by forming etching patterns beforehand on the surface(s) of the steel sheet.

Figure 6:
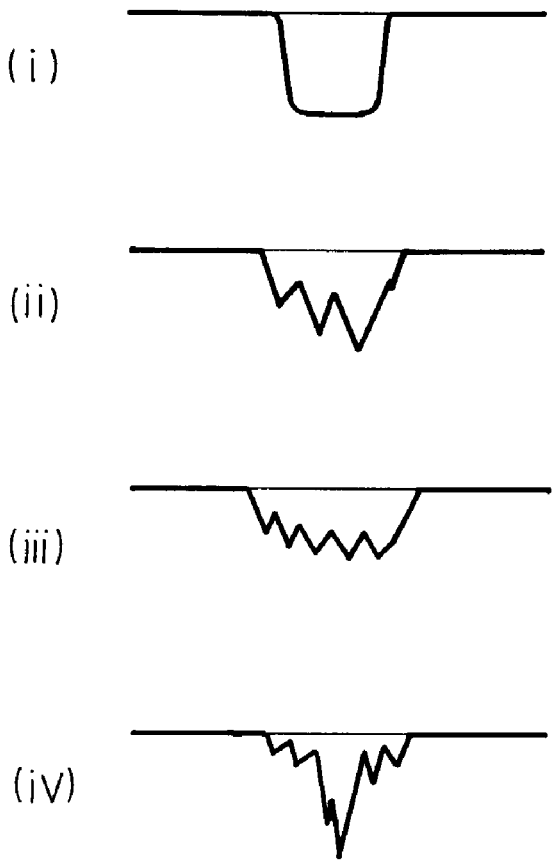
FIG. 6 is an illustration showing sectional shape patterns of the grooves formed by electrolytic etching in classification.
Figure 7:
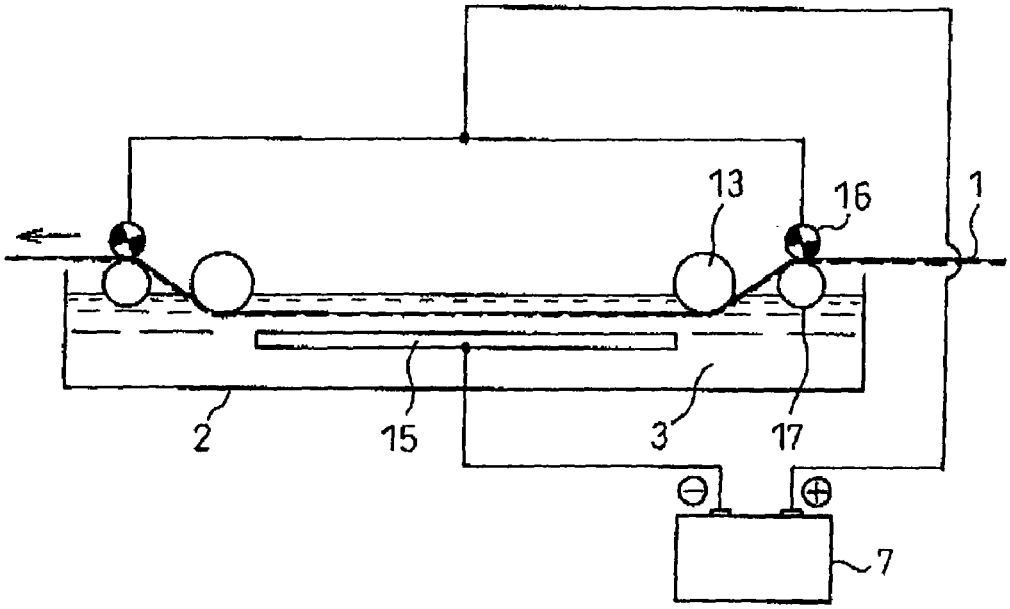
Fig. 7 PRIOR ART
FIG. 7 is a schematic illustration, in the form of a longitudinal elevation view in section, of a conventional direct-electrification-type continuous electrolytic etching apparatus for a metal strip.

Next, the present inventors examined the shape of the grooves formed through the above electrolytic etching in detail. Examples (i) to (iv) of observed shapes of the electrolytically etched grooves are shown in FIG. 6. As seen in the classification into the (i) U-shaped type, (ii) sloped type, (iii) widened type and (iv) locally etched type, it became clear that the geometric shape of the grooves was very unstable and their width and depth were prone to fluctuate significantly. It was also observed that the percentage of the (i) U-shaped type groove shape, the most preferable, was comparatively low.

Based on the above result, the present inventors formed grooves under different electrolysis conditions (NaCl concentration, electrolyte temperature, effective current density at the groove portions) on metal strips of different steel grades aiming at forming grooves having the (i) U-shaped type section shape, and investigated the shape of the grooves formed under the various conditions, but it proved difficult to stabilize the shape of the grooves and significantly reduce the fluctuation of their depth and width by these measures.

The present inventors devoted themselves to further studies and, focusing attention on the mass transfer within the grooves formed by the electrolytic etching and, in particular, on the stagnation of the electrolyte (precipitate from the solution), hit upon an idea that the shape of the grooves formed through the etching could be made stable and their width and depth more homogeneous by effectively reducing the stagnation and making the mass transfer smooth. The present inventors conducted tests for verifying the idea and, as a result, they discovered that generating $H_2$ gas periodically for very short periods of time during the electrolytic etching process on the surface of the grooves formed was very effective as a measure for reducing the stagnation of the electrolyte (precipitate from the solution). This is explained below by referring to the attached drawings.

Figure 3:
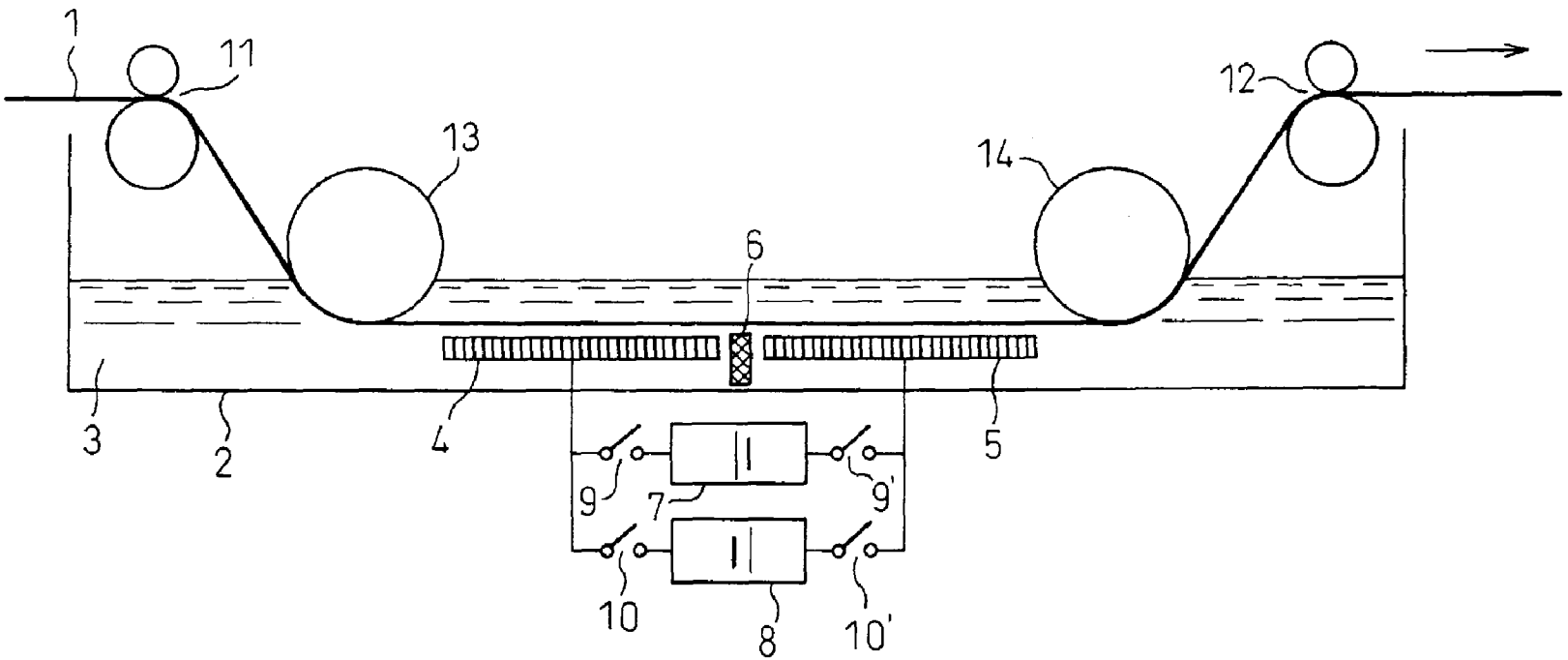
FIG. 3 is a schematic illustration, in the form of a longitudinal elevation view in section, of an apparatus according to the present invention for continuously forming grooves by indirect-electrification-type electrolytic etching on a metal strip on which an etching mask is formed in etching patterns at least on one of the surfaces.

FIG. 3 schematically shows, in the form of a longitudinal elevation view in section, the construction of an apparatus according to the present invention for forming grooves by indirect-electrification-type electrolytic etching on a metal strip to be etched on one or both surfaces and having an etching mask formed in etching patterns at least on the surface to be etched.

The main configuration of the apparatus is as follows. Facing the surface to be etched of a metal strip 1 continuously fed having an etching mask formed selectively on one of the surfaces, an electrode A 4 and an electrode B 5 are arranged in this order in the travelling direction of the metal strip. The space between the metal strip 1 and the electrodes A 4 and B 5 is filled with an electrolyte 3. Direct current electric power supply apparatuses 7 and 8 are connected to the electrodes A 4 and B 5. Switches 9 and 10 are provided between the direct current electric power supply apparatuses 7 and 8 and the electrode A 4, respectively, and, switches 9' and 10' are provided between the direct current electric power supply apparatuses 7 and 8 and the electrode B 5, respectively. By closing the switches 9 and 9' and opening the switches 10 and 10', a voltage is applied across the electrodes A 4 and B 5 in a manner that the electrode A 4 is positively impressed, and, by opening the switches 9 and 9' and closing the switches 10 and 10', a voltage is applied across the electrodes A 4 and B 5 in a manner that the electrode A 4 is negatively impressed. Further, by opening all the switches 9, 9', 10 and 10', the voltage application is discontinued.

In addition, for the purpose of inhibiting leakage current, namely, the direct flow of electric current from the electrode A 4 to the electrode B 5 or from the electrode B 5 to the electrode A 4 through the electrolyte 3, an insulating plate 6 composed of an electrically nonconductive material is provided between the electrode A 4 and the electrode B 5 in the electrolysis tank 2.

Figure 4:
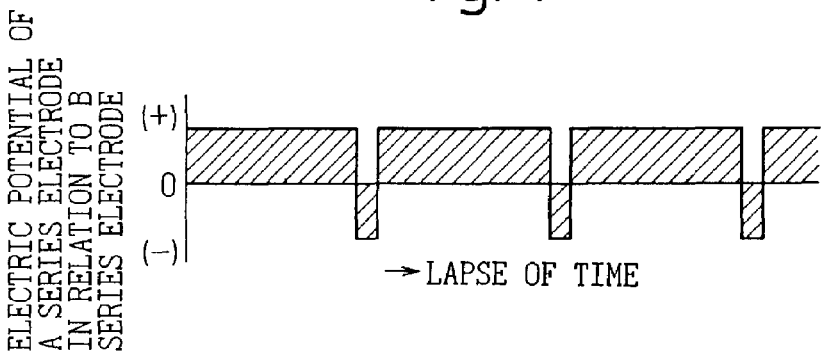
FIG. 4 is a diagram showing an example of the voltage application across an A series electrode and a B series electrode of the apparatus according to the present invention in terms of the voltage of the A series electrode.

FIG. 4 shows an example of the voltage application across the electrodes A and B according to the present invention in terms of the voltage of the electrode A.

In most cases, the electric circuit is so adjusted that a prescribed electrolysis current flows at the voltage application across the electrodes A and B to positively impress the electrode A 4 and the other to negatively impress the same.

For example, when the voltage application is such that the electrode A 4 is positively impressed (it becomes an anode), a prescribed electrolysis current flows from the electrode A 4 to the metal strip 1 through the electrolyte 3 and the etching pattern portion of the metal strip 1 (functioning as a cathode) facing said electrode, and then to the electrode B 5 (functioning as a cathode) through the etching pattern portion of the metal strip 1 (functioning as an anode) and the electrolyte 3 facing the electrode B 5. With the electrolysis current, the process of electrolytic etching proceeds at an etching pattern portion of the metal strip 1 on the side facing the electrode B 5 through the anodic reaction:

$$Me \rightarrow Me^{+} + e^{-},$$

$$(Fe \rightarrow Fe^{2+} + 2^{e-}, \text{ when the metal strip is a steel strip}).$$

In contrast, when the voltage application is such that the electrode A 4 is negatively impressed (it becomes a cathode), a prescribed electrolysis current flows in the opposite direction to the above case and, at this time, at the etching pattern portions of the metal strip 1 on the side facing the electrode B 5 (functioning as an anode), the stagnation of the electrolyte (precipitate from the solution) near the etching pattern portions (functioning as a cathode) occurring during the electrolytic etching is reduced by the $H_2$ gas formed through the cathodic reaction (electron acceptance reaction):

$$2H^{+} + 2e^{-} \rightarrow H_2\uparrow.$$

Note that, by the present invention, either of the electrodes A 4 and B 5 becomes an anode or a cathode from time to time, and that, for this reason, it is desirable to make them of an insoluble material such as a Pt material in order that the electrode itself is not electrolytically etched when it is functioning as an anode.

In addition, as a measure for electrolytically etching a metal strip at a high speed, it is effective to provide the electrodes A and B in the electrolysis tank alternately in plural sets, like, A B A B . . . A B. It is also effective to provide more than one electrolysis tank. Note that the plural electrodes A or electrodes B are herein collectively referred to as the A series electrodes or B series electrodes, respectively, and, they may also be referred to simply as the electrodes A or electrodes B, respectively.

With regard to the voltage application pattern shown in FIG. 4, it is necessary to apply voltage across the electrodes A and B alternately repeating (I) a voltage application wherein an A series electrode becomes a cathode for a period of time M of 3 to 10 msec. and (II) a voltage application wherein the A series electrode becomes an anode for a period of time N of 4×M to 20×M msec.

When an A series electrode functions as a cathode and a B series electrode as an anode under the above voltage application (I), letting M represent the period of time (msec.) of the voltage application, if the voltage application is for a period of time M less than 3 msec., then the $H_2$ gas generation at the surface of the grooves formed by the etching is not sufficient for removing the stagnation of the electrolyte (precipitate) in the grooves; if the voltage application is for a period of time M exceeding 10 msec., on the other hand, then the current efficiency of the electrolytic etching is lowered. For this reason, the period of time M is defined as 3 to 10 msec.

Inversely, when an A series electrode functions as an anode and a B series electrode as a cathode under the above voltage application (II), letting N represent the period of time (msec.) of the voltage application, if the voltage application is for a period of time N less than 4×M msec., then the current efficiency of the electrolytic etching is lowered; if the voltage application is for a period of time N exceeding 20×M msec., on the other hand, then the stagnation of the electrolyte (precipitate) in the grooves formed by the electrolytic etching becomes too large and it becomes difficult to remove the stagnation of the electrolyte (precipitate) from the grooves. For this reason, the period of time N is defined as 4×M to 20×M msec.

Now, the arrangement of the electrodes wherein more than one pair of the electrodes A and B or more than one electrolysis tank are provided is explained below. Generally speaking, from the viewpoint of preventing the substances in the electrolyte from sticking to a metal strip (a cathode) through cathodic reactions (making the etching pattern portion of the metal strip work as an anode), it is desirable that the final electrode in the travelling direction of the metal strip be a cathode. While each of the electrodes A and B is used as an anode and a cathode alternately from time to time according to the present invention, since the time distribution of the voltage applications under the above (I) and (II) is such that N>M is always true, a B electrode functions as a cathode for most of the time. For this reason, it is desirable that, from the viewpoint of preventing the substances in the electrolyte from sticking to the metal strip, the final electrode in the travelling direction of the metal strip be a B series electrode, which functions mainly as a cathode.

Figure 5:
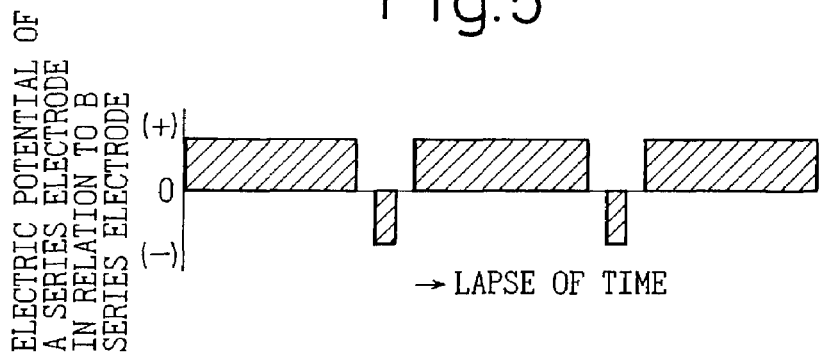
FIG. 5 is a diagram showing another example of the voltage application across an A series electrode and a B series electrode of the apparatus according to the present invention in terms of the voltage of the A series electrode.

It is also effective, for performing the electrolytic etching stably, to insert, between voltage applications, periods of time during which no voltage is applied across the A series and B series electrodes, that is, for a period of time $\alpha$ msec. ($\alpha>0$) at the change from the voltage application (I) to the voltage application (II) and/or for a period of time $\beta$ msec. ($\beta>0$) at the change from the voltage application (II) to the voltage application (I). This is because, in an actual electrolytic etching facility, electric circuits, so-called LC circuits, are formed between an electrolysis power supply apparatus and electrodes A and B and between the electrodes A and B and a metal strip, respectively, and a delay occurring on the occasion of the anode/cathode change between the two types of voltage applications may constitute a problem. The larger the scale of a facility, the more obvious the problem of the delay occurring in an LC circuit becomes. FIG. 5 shows an example of the voltage application across the A series and B series electrodes according to the present invention for solving such a problem, in terms of the voltage of the electrode A.

It is not desirable, however, to make the no-voltage application period so long that $\alpha$ or $\beta$ exceeds 10 msec., because this leads to reduction in the electrolytic etching velocity or lengthening of an electrolytic etching facility (electrolysis tank). When $\alpha$ or $\beta$ is less than 1 msec., on the other hand, such a short no-voltage application period cannot be an effective measure for solving the problem of the delay occurring in an LC circuit, and, for this reason, it is desirable to control $\alpha$ and $\beta$ within the range from 1 to 10 msec, respectively.

The present inventors applied voltage across the electrodes A and B of an apparatus shown in FIG. 3 in the manner shown in FIG. 5 in terms of the voltage of the electrode A, formed grooves by electrolytic etching on metal strips having an etching mask formed in etching patterns, and observed the shape (geometrical shape, width and depth) of the grooves thus formed. As a result, it was confirmed that the shape of the grooves formed through the electrolytic etching according to the present invention was made so stable that all of them had the U-shaped type section as shown in item (i) of FIG. 6, and their width and depth became more even, exhibiting greatly reduced fluctuations.

Note that the metal strips 1 used for the tests were final-annealed grain-oriented silicon steel sheets, and coating films of forsterite ($Mg_2SiO_4$) formed during the final annealing, and tension coating films (insulating coating films of a phosphate system) on top of said coating films had been formed on both their surfaces through painting and then baking. On one of the surfaces, etching patterns had been formed in which the forsterite coating film and the tension coating film were selectively removed by a laser beam to expose the steel base material. Note that, as the tension coating film is an electrically insulating coating film, it can be used as an etching mask. A NaCl aqueous solution was used as the electrolyte 3.

The electrolysis power supply apparatus to be employed in the present invention is not limited to the switching system using a direct current power supply apparatus and switches described before; any power supply method is acceptable as far as it is capable of realizing the voltage application cycles described earlier. A system using a transistor or an inverter having a so-called 6-phase half-wave rectification waveform is also effective.

The present invention is effective for any case of continuously and stably forming grooves by indirect-electrification-type electrolytic etching on a metal strip to be etched at one or both surfaces and having an etching mask formed in etching patterns at least on the surface to be etched. When only one surface of a metal strip is to be etched, the other surface may be covered entirely with an etching mask or it may be left without any etching mask.

Figure 8:
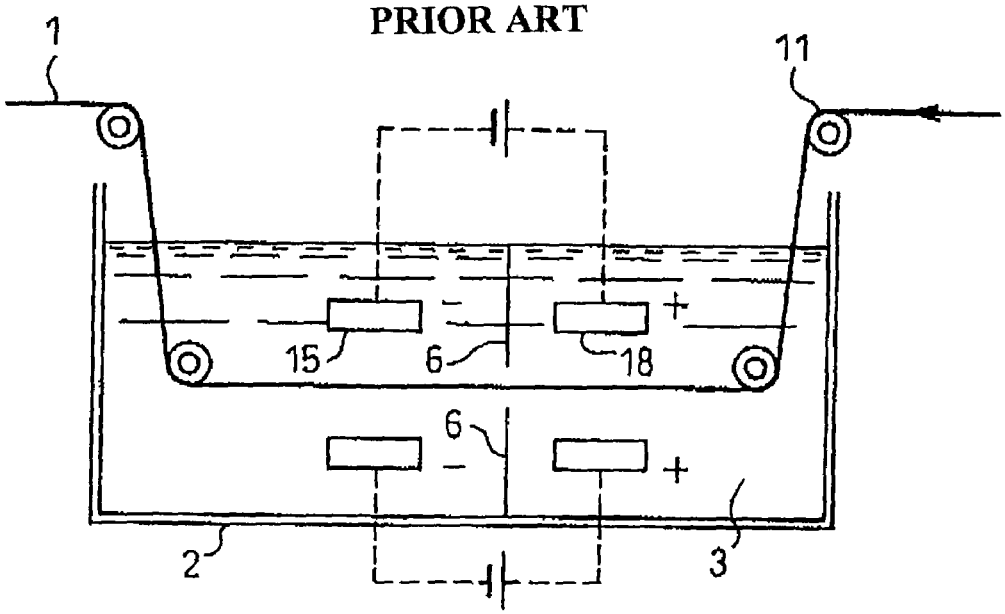
Fig. 8 PRIOR ART
FIG. 8 is a schematic illustration, in the form of a longitudinal elevation view in section, of a conventional indirect-electrification-type continuous electrolytic pickling apparatus for a metal strip.

While an apparatus for electrolytic etching of one surface of a metal strip is as exemplified in FIG. 1 or 3, an apparatus for electrolytic etching of both surfaces of a metal strip can be configured simply by modifying the apparatus exemplified in FIG. 1 or 3 so that a group of electrodes and a power supply apparatus are provided for each of the upper and lower surfaces of the metal strip as in the apparatus shown in FIG. 8. Therefore, in the present description, the apparatus for the electrolytic etching of both surfaces is not shown, with a drawing, as an example of the present invention.

The effect of the present invention is outstanding especially when the present invention is applied to a "stress-relief-annealing-resistant, low-core-loss, grain-oriented silicon steel sheet not susceptible to the deterioration of core loss by stress-relief annealing" produced through electrolytic etching of a final-annealed silicon steel sheet with an etching mask formed on the surfaces. This is because, in the case of such a silicon steel sheet, the fluctuation of the shape of the grooves formed by electrolytic etching directly shows as a manifest problem of the fluctuation of its magnetic property.

The present invention is, naturally, effective also when applied to a grain-oriented silicon steel sheet having the tension coating films (insulating coating films of a phosphate system) formed by painting and an etching mask formed selectively on one of the surfaces but not having the forsterite ($Mg_2SiO_4$) coating films.

Next, with regard to the electrolyte, the present inventors examined the dissolution of iron ions and the precipitation of iron hydroxide involved in the electrolytic etching. It became clear through the tests of the present inventors that, when the value of pH of the electrolyte was 7 or lower, iron dissolved in the electrolyte without forming precipitates and the disposal of the electrolyte was rendered easy. If iron precipitates, then piping is clogged, waste electrolyte disposal is hindered, and more maintenance work is required. For this reason, it is desirable to avoid the precipitation.

When the value of pH is high, iron does not dissolve in the electrolyte but precipitates. According to the tests of the present inventors, iron precipitates when the value of pH of the electrolyte is 8 or higher, which is very convenient from the viewpoint, contrary to the above, of recovering iron. There are two alternative ways of waste electrolyte disposal: one is to dissolve iron in the electrolyte and dispose of the solution, and the other is to have iron precipitate, recover it through a filter and dispose of the remaining solution. Therefore, either of the methods suitable for the environmental conditions of the facility can be selected.

First, it is desirable to control the value of pH of the electrolyte to 2 or higher and 11 or lower. The reason why the value of pH has to be 2 or higher is that, if it is below 2, the insulating coating film used as the etching resist material deteriorates. When the insulating coating film deteriorates, precise groove patterns will be destroyed, the electrolysis current will flow also to portions where grooves are not required, and these portions will be etched. Thus, the characteristic of the coating film as an etching resist becomes insufficient, and sharp grooves having a desired shape cannot be formed.

On the other hand, the reason why the value of pH has to be 11 or lower is that, if it exceeds 11, the insulating coating film deteriorates, the characteristic of the coating film as an etching resist becomes insufficient, and grooves of the intended U-shaped section cannot be formed.

It is also desirable to control the value of pH of the electrolyte to 2 or higher and 7 or lower. The reason why the value of pH has to be 7 or lower is that, by this, iron is prevented from precipitating, and iron precipitate is not deposited in piping and does not obstruct the flow of waste liquor. As a consequence, additional facilities for removing the iron precipitate such as a HOFFMAN filter are not required, and the electrolyte in which iron is dissolved can be led from an electrolysis tank to a waste liquor treatment tank or the like directly through a simple piping system. The reason why the value of pH has to be 2 or higher is the same as described above.

It is also desirable to control the value of pH of the electrolyte to 8 or higher and 11 or lower. The reason why the value of pH has to be 8 or higher is that, by this, iron easily precipitates, and the precipitate can easily be recovered using a filter or the like, and the waste liquor disposed of. In this case, besides the HOFFMAN filter mentioned earlier, a dialysis membrane, through which iron ions can hardly pass, may be used. The reason why the value of pH has to be 11 or lower is the same as described above.

EXAMPLE

The present invention is explained concretely based on examples hereafter.

Examples 1 to 5

The metal strips in these examples before electrolytic etching were grain-oriented silicon steel sheets cold-rolled to the final thickness, decarburization-annealed, painted with an anti-sticking agent for annealing consisting of MgO on both the surfaces and dried, then final-annealed, and having tension coating films (insulating coating films of a phosphate) formed through painting and baking on the coating films of forsterite ($Mg_2SiO_4$) that had formed during the final annealing on both the surfaces. They were also grain-oriented silicon steel sheets having, in addition, etching patterns formed on one of the surfaces by selectively removing the forsterite coating film and tension coating film using a laser beam to expose the steel base material. Note that, as the tension coating film was an electrically insulating coating film, it was used as the etching mask.

The grain-oriented silicon steel sheets pretreated as described above were subjected to an electrolytic etching treatment using an indirect-electrification-type continuous electrolytic etching apparatus as shown in FIG. 1 or 3.

[Grain-oriented silicon steel sheet]

Thickness: 0.22 mm; width: 1,000 mm

[Etching mask]

In etching patterns, each 0.2 mm in width, at intervals of 3 mm, in the direction in right angles to the longitudinal direction (width direction) of the steel sheet

[Electrolyte]

Composition: 500 g-NaCl/l;

Temperature: 60° C.

[Target groove depth]

0.02 mm

[Electrolysis current]

350 c/dm$^2$

After the electrolytic etching, the shape patterns of the grooves formed through the electrolytic etching in the width direction of the steel sheets and the fluctuation of the groove depth were evaluated.

Table 1 shows the conditions of the test using an apparatus as shown in FIG. 1 or 3 and applying voltage as shown in any one of FIGS. 2, 4 and 5, and the results thereof.

It is clear from the table that, in the examples according to the present invention shown as invention examples 1 to 5, the shape of all the grooves was of the U-shaped type (i) and stable, and, as a result, the fluctuation (%) of the groove depths ((standard deviation of groove depths)/(average of groove depths)×100) was extremely small. In passing, a special circuit configuration for avoiding the delay problem occurring in an LC circuit was used in invention example 5, but a detail explanation of the circuit configuration is omitted, since it was based on a publicly known technology.

In contrast, in comparative example 1 wherein the time of the voltage application to negatively impress an electrode A was short and in comparative examples 2 and 3 wherein the ratio of the time of positive voltage application to the electrode A to the time of negative voltage application to the same exceeded 20, although the U-shaped type (i) groove shape was sometimes observed, the shape was still a mixture of the sloped type (ii), widened type (iii) and locally etched type (iv) sections, and, as a result, the fluctuation of the groove depth was large.

In comparative example 4, wherein the voltage application method shown in FIG. 2 was used, the U-shaped type (i) section was not observed, and the groove shape was a mixture of the sloped type (ii), widened type (iii) and locally etched type (iv) sections, and, as a result, the fluctuation of the groove depth was larger still.

TABLE 1

| | Voltage application across electrodes A and B in terms of voltage of electrode A | | | No voltage application time | | Groove shape | | | | Fluctuation of groove |
|---|---|---|---|---|---|---|---|---|---|---|
| No. | Negative voltage time (msec) | Positive voltage time (msec) | Pattern | α (msec) | β (msec) | (i) (%) | (ii) (%) | (iii) (%) | (iv) (%) | depth (%) |
| Invention example 1 | 3 | 12 | FIG. 5 | 3 | 3 | 100 | 0 | 0 | 0 | 8.0 |
| Invention example 2 | 3 | 60 | FIG. 5 | 3 | 7 | 100 | 0 | 0 | 0 | 7.8 |
| Invention example 3 | 10 | 40 | FIG. 5 | 7 | 10 | 100 | 0 | 0 | 0 | 7.6 |
| Invention example 4 | 10 | 200 | FIG. 5 | 10 | 10 | 100 | 0 | 0 | 0 | 8.2 |
| Invention example 5 | 7 | 100 | FIG. 4 | 0 | 0 | 100 | 0 | 0 | 0 | 8.1 |
| Comparative example 1 | 1 | 12 | FIG. 5 | 3 | 3 | 50 | 20 | 10 | 20 | 10.3 |
| Comparative example 2 | 3 | 120 | FIG. 5 | 3 | 7 | 60 | 10 | 10 | 20 | 10.0 |
| Comparative example 3 | 10 | 300 | FIG. 5 | 7 | 10 | 25 | 25 | 25 | 25 | 10.5 |
| Comparative example 4 | nil | contin-uous | FIG. 2 | — | — | 0 | 30 | 40 | 30 | 11.5 |

Example 6

Etching patterns, each 0.3 mm in width, were formed at intervals of 6 mm by laser beam irradiation on steel sheets which had been finish-rolled to a thickness of 0.23 mm by cold rolling, final-annealed as grain-oriented electrical steel sheets and painted with insulating coating films, and, then, the steel sheets were processed in an electrolysis tank in which a cathode and an anode were arranged alternately so as to face the surface of the steel sheets where the steel base material was partially exposed. Here, a 5%-aqueous solution of sodium chloride was used as the electrolyte and its pH value was adjusted using sodium hydroxide and hydrochloric acid. The etching was conducted under different values of pH ranging from 1 to 12.

The specimens according to the present invention were taken out and the shapes of grooves were examined; grooves about 20 μm in average depth had been formed. Table 2 shows the result of the investigation of the amounts of iron precipitation in the electrolysis tank during the processing. The amount of iron precipitation was measured, in terms of the weight of iron in the solution scooped up in a beaker, by retaining the iron in a filter paper. For reference, the capacity of the electrolysis tank was 84 l, the effective current density at the groove portions was 600 A/dm$^2$, and the values in the table are those after 40 sec. of processing in the electrolysis tank.

TABLE 2

| pH | 1.2 | 2.5 | 3.3 | 4.7 | 5.7 | 6.1 | 7.9 | 8.3 | 9.5 | 10.0 | 11.8 | 12.3 |
|---|---|---|---|---|---|---|---|---|---|---|---|---|
| Iron Precipitation amount (μg/ml) | 0 | 0 | 0 | 0 | 0 | 10 | 150 | 210 | 335 | 468 | 556 | 625 |

As shown in Table 2, the precipitation began when the value of pH was raised to 6, and its amount increased significantly when the value of pH was 8 or higher. Therefore, by keeping the value of pH at 7 or lower within the above range of conditions, it was possible to transfer the electrolyte from the electrolysis tank to a waste liquor tank without any additional treatment, keeping iron substantially dissolved in it.

Example 7

Etching patterns, each 0.3 mm in width, were formed at intervals of 4 mm by laser beam irradiation on steel sheets finish-rolled to a thickness of 0.27 mm by cold rolling, final-annealed as grain-oriented electrical steel sheets and painted with insulating coating films. Then, the steel sheets having portions where the steel base material was exposed at one of the surfaces were processed in an electrolysis tank in which a cathode and an anode were arranged alternately so as to face said surface of the steel sheets. Here, a 3%-aqueous solution of potassium chloride was used as the electrolyte and its value of pH was adjusted using sodium hydroxide and hydrochloric acid. The etching was conducted under different values of pH ranging from 1 to 12.

The shapes of grooves formed on the above specimens were examined; grooves about 15 μm in average depth had been formed.

Table 3 shows the result of the investigation of the amount of iron precipitation in the electrolysis tank during the processing. The amount of iron precipitation was measured, in terms of the weight of iron in the solution scooped up in a beaker, by retaining the iron in a filter paper. For reference, the capacity of the electrolysis tank was 84 l, the effective current density at the groove portions was 1,200 A/dm$^2$, and the values in the table are those after 17 sec. of processing in the electrolysis tank.

TABLE 3

| pH | 1.1 | 2.9 | 3.4 | 4.8 | 5.6 | 6.5 | 7.8 | 8.4 | 9.9 | 10.6 | 11.5 | 12.8 |
|---|---|---|---|---|---|---|---|---|---|---|---|---|
| Iron Precipitation amount (μg/ml) | 0 | 0 | 0 | 0 | 53 | 109 | 254 | 450 | 624 | 895 | 1142 | 1410 |

As is clear from Table 3, the precipitation began when the value of pH was raised to 5, and its amount increased significantly when the value of pH was 8 or higher. Therefore, by keeping the value of pH at 7 or lower within the above range of conditions, it was possible to transfer the electrolyte from the electrolysis tank to a waste liquor tank without any additional treatment and keeping iron substantially dissolved in it.

Example 8

Etching patterns, each 0.3 mm in width, were formed at intervals of 6 mm on steel sheets finish-rolled to a thickness of 0.23 mm by cold rolling, final-annealed as grain-oriented electrical steel sheets and painted with insulating coating films. Then, the steel sheets having portions where the steel base material was exposed at one of the surfaces were processed in an electrolysis tank in which a cathode and an anode were arranged alternately so as to face said surface of the steel sheets. Here, a 7%-aqueous solution of calcium chloride was used as the electrolyte and its value of pH was adjusted using sodium hydroxide and hydrochloric acid. The etching was conducted under different values of pH ranging from 1 to 12.

The specimens according to the present invention were taken out and the shapes of grooves were examined; grooves about 25 μm in average depth had been formed. Table 4 shows the result of the investigation of the amounts of iron precipitation in the electrolysis tank during the processing. The amount of iron precipitation was measured, in terms of the weight of iron in the solution scooped up in a beaker, by retaining the iron in a filter paper. For reference, the capacity of the electrolysis tank was 84 l, the effective current density at the groove portions was 700 A/dm$^2$, and the values in the table are those after 40 sec. of processing on the processing line.

TABLE 4

| pH | 1.8 | 2.2 | 3.5 | 4.7 | 5.7 | 6.1 | 7.8 | 8.1 | 9.5 | 10.8 | 11.4 | 12.0 |
|---|---|---|---|---|---|---|---|---|---|---|---|---|
| Iron Precipitation amount (μg/ml) | 0 | 0 | 0 | 0 | 0 | 10 | 150 | 210 | 335 | 468 | 556 | 625 |

As is clear from Table 4, the precipitation began when the value of pH was raised to 6, and its amount increased significantly when the value of pH was 8 or higher. Therefore, by keeping the value of pH at 8 or higher within the above range of conditions, it was possible to dispose of the electrolyte after having iron precipitate effectively, and continuously form grooves on the final-annealed sheet materials. The electrolyte was transferred from the electrolysis tank through a filter, with which the iron precipitate was collected, and then, after being stored once in a settling tank to have solids precipitate, to a waste liquor tank.

Example 9

Etching patterns, each 0.3 mm in width, were formed at intervals of 4 mm on steel sheets finish-rolled to a thickness of 0.27 mm by cold rolling, final-annealed as grain-oriented electrical steel sheets and painted with insulating coating films. Then, the steel sheets having portions where the steel base material was exposed at one of the surfaces were processed in an electrolysis tank in which a cathode and an anode were arranged alternately so as to face said surface of the steel sheets. Here, a 5%-aqueous solution of sodium nitrate was used as the electrolyte and its value of pH was adjusted using sodium hydroxide and hydrochloric acid. The etching was conducted under different values of pH ranging from 1 to 12.

The specimens according to the present invention were taken out and the shapes of grooves were examined; grooves about 17 μm in average depth had been formed. Table 5 shows the result of the investigation of the amounts of iron precipitation in the electrolysis tank during the processing. The amount of iron precipitation was measured, in terms of the weight of iron in the solution scooped up in a beaker, by retaining the iron in a filter paper. For reference, the capacity of the electrolysis tank was 84 l, the effective current density at the groove portions was 1,200 A/dm$^2$, and the values in the table are those after 20 sec. of processing on the processing line.

TABLE 5

| pH | 1.5 | 2.1 | 3.9 | 4.5 | 5.3 | 6.4 | 7.0 | 8.8 | 9.4 | 10.6 | 11.9 | 12.4 |
|---|---|---|---|---|---|---|---|---|---|---|---|---|
| Iron Precipitation amount (μg/ml) | 0 | 0 | 0 | 0 | 53 | 109 | 254 | 450 | 624 | 895 | 1142 | 1410 |

As is clear from Table 5, the precipitation began when the value of pH was raised to 5, and its amount increased significantly when the value of pH was 8 or higher. Therefore, by keeping the value of pH at 8 or higher within the above range of conditions, it was possible to have iron precipitate effectively, and to continuously form grooves on the final-annealed sheet materials. The electrolyte was transferred from the electrolysis tank through a filter, with which the iron precipitate was collected, and then, after being stored once in a settling tank to have solids precipitate, to a waste liquor tank.

INDUSTRIAL APPLICABILITY

As has been explained above, it is possible by the present invention to favorably solve the problem of low efficiency in electrolytically etching both surfaces of a metal strip by direct-electrification-type electrolytic etching, by which only one side can be treated in one processing, as well as the conventional problem of direct-electrification-type electrolytic etching not being capable of conducting the electrolytic etching of a metal strip having etching masks on both the surfaces. It is also possible by the present invention to stabilize the shape of grooves formed by electrolytic etching and make their width and depth more homogeneous by favorably solving also the conventional problem of the shape of electrolytically etched grooves by the indirect-electrification-type electrolytic etching and, in addition, satisfy both the selectivity to allow the formation of grooves only at the portions of good recrystallization and the controllability of the groove depth. Further, the present invention makes it possible to efficiently treat the electrolyte of the electrolytic etching. Due to the above, the present invention provides a method for indirect-electrification-type continuous electrolytic etching of a metal strip suitable, in particular, for the production of a low-core-loss, grain-oriented silicon steel sheet not susceptible to the deterioration of core loss after stress-relief annealing used for the magnetic core of a power supply transformer and the like, and an apparatus for the indirect-electrification-type continuous electrolytic etching.

All cited references and specifications are hereby incorporated herein by reference in their entireties.

The invention claimed is:

1. A method for an indirect-electrification-type continuous electrolytic etching of a metal strip to continuously form grooves on the metal strip, the grooves being etched on at least one surface of the metal strip, the at least one surface including an etching mask provided in etching patterns thereon, comprising the steps of:

(a) arranging at least one A series electrode and at least one B series electrode alternately at least in a pair with respect to one another to be in a particular order in a travelling direction of the metal strip so that the at least one A series and at least one B series electrodes face the at least one surface of the metal strip to be etched;

(b) filling a space between the metal strip and the at least one A and at least one B series electrodes with an electrolyte; and (c) applying voltage across the at least one A series and at least one B series electrodes by alternately repeating:

(I) a first voltage application in which the at least one A series electrode becomes a cathode for a first time period (M) of 3 ms to 10 ms, and (II) a second voltage application in which the at least one A series electrode becomes an anode for a second time period (N) that is 4×M ms to 20×M ms.

2. The method of claim 1, further comprising the step of discontinuing the voltage application across the at least one A series and at least one B series electrodes for at least one of:

a third non-zero time period at a first voltage change from the first voltage application to the second voltage application, and a fourth non-zero time period at a second voltage change from the second voltage application to the first voltage application.

3. The method according to claim 1, wherein a final electrode within the A series and B series electrodes arranged in the travelling direction of the metal strip is one of the at least one B series electrode.

4. The method according to claim 1, wherein the pair of the A series and B series electrodes are lined up in the order in the travelling direction of the metal strip for each side of the metal strip.

5. The method according to claim 1, wherein the metal strip is a final-annealed grain-oriented silicon steel sheet having an insulating coating film on a surface thereof, and wherein the insulating coating film is used as the etching mask.

6. The method according to claim 1, wherein the metal strip is a cold-rolled grain-oriented silicon steel sheet.

7. The method according to claim 5, wherein the insulating coating film of the grain-oriented silicon steel sheet has a forsterite coating film on a surface thereof and a surface-tension insulating coating film formed on the coating film.

8. The method according to claim 5, wherein the insulating coating film of the grain-oriented silicon steel sheet has a surface-tension insulating coating film formed on a surface of a steel base material.

9. The method according to claim 1, further comprising the step of controlling a value of pH of the electrolyte to approximately at least 2 and at most 11.

10. The method according to claim 1, further comprising the step of controlling a value of pH of the electrolyte to approximately at least 2 and at most 7.

11. The method according to claim 1, further comprising the step of controlling a value of pH of the electrolyte to approximately at least 8 and at most 11.

* * * * *